US010633732B2

(12) United States Patent
Thomas et al.

(10) Patent No.: US 10,633,732 B2
(45) Date of Patent: Apr. 28, 2020

(54) TITANIUM ALLOYS EXHIBITING RESISTANCE TO IMPACT OR SHOCK LOADING AND METHOD OF MAKING A PART THEREFROM

(71) Applicant: Titanium Metals Corporation, Henderson, NV (US)

(72) Inventors: Roger Owen Thomas, Swansea (GB); Yoji Kosaka, Henderson, NV (US); Steven James, Henderson, NV (US); Paul Garratt, Swansea (GB)

(73) Assignee: Titanium Metals Corporation, Henderson, NV (US)

( * ) Notice: Subject to any disclaimer, the term of this patent is extended or adjusted under 35 U.S.C. 154(b) by 0 days.

(21) Appl. No.: 16/008,609

(22) Filed: Jun. 14, 2018

(65) Prior Publication Data

US 2018/0291492 A1 Oct. 11, 2018

Related U.S. Application Data

(62) Division of application No. 14/606,310, filed on Jan. 27, 2015, now Pat. No. 10,000,838.

(Continued)

(51) Int. Cl.
*C22F 1/18* (2006.01)
*C22C 14/00* (2006.01)

(Continued)

(52) U.S. Cl.
CPC ..... *C22F 1/183* (2013.01); *C22C 14/00* (2013.01); *F04D 29/023* (2013.01); *F04D 29/522* (2013.01)

(58) Field of Classification Search
CPC ..... C22C 14/00; C22F 1/183
See application file for complete search history.

(56) References Cited

U.S. PATENT DOCUMENTS

2001/0050117 A1* 12/2001 Oyama ..... C22C 14/00 148/421
2005/0202271 A1* 9/2005 Yashiki ..... B32B 15/017 428/660

(Continued)

FOREIGN PATENT DOCUMENTS

CN 101010438 8/2007
GB 776440 * 10/1953

(Continued)

OTHER PUBLICATIONS

Kolachev B.A. et al, "Titanium alloys of different countries", M, VILS, 2000, p. 35.

*Primary Examiner* — Anthony J Zimmer
*Assistant Examiner* — Ricardo D Morales
(74) *Attorney, Agent, or Firm* — Burris Law, PLLC

(57) ABSTRACT

Titanium alloys formed into a part or component used in applications where a key design criterion is the energy absorbed during deformation of the part when exposed to impact, explosive blast, and/or other forms of shock loading is described. The titanium alloys generally comprise a titanium base with added amounts of aluminum, an isomorphous beta stabilizing element such as vanadium, a eutectoid beta stabilizing element such as silicon and iron, and incidental impurities. The titanium alloys exhibit up to 70% or more improvement in ductility and up to a 16% improvement in ballistic impact resistance over a Ti-6Al-4V alloy, as well as absorbing up to 50% more energy than the Ti-6Al-4V alloy in Charpy impact tests. A method of forming a part that incorporates the titanium alloys and uses a combination of recycled materials and new materials is also described.

20 Claims, 3 Drawing Sheets

Related U.S. Application Data

(60) Provisional application No. 61/932,410, filed on Jan. 28, 2014.

(51) Int. Cl.
*F04D 29/02* (2006.01)
*F04D 29/52* (2006.01)

(56) References Cited

U.S. PATENT DOCUMENTS

| | | | | |
|---|---|---|---|---|
| 2008/0092997 | A1 | 4/2008 | Matsumoto | |
| 2009/0035172 | A1 | 2/2009 | Sibum et al. | |
| 2012/0107132 | A1* | 5/2012 | Thomas | C22F 1/183 416/241 R |

FOREIGN PATENT DOCUMENTS

| | | | | |
|---|---|---|---|---|
| GB | 2447036 A * | 9/2008 | | F01D 21/045 |
| JP | 2006034414 | 2/2006 | | |

* cited by examiner

Microstructure of Alloy F-3

TITANIUM ALLOYS EXHIBITING RESISTANCE TO IMPACT OR SHOCK LOADING AND METHOD OF MAKING A PART THEREFROM

CROSS-REFERENCE TO RELATED APPLICATIONS

This application is a divisional application and claims the benefit of the U.S. patent application Ser. No. 14/606,310 filed on Jan. 27, 2015, which in turn claims the benefit of the filing date under 35 U.S.C. § 119(e) of U.S. Provisional Application No. 61/932,410 filed Jan. 28, 2014, both of which are incorporated herein in their entirety by reference.

FIELD

This disclosure relates generally to titanium alloys. More specifically, this disclosure relates to titanium alloys formed into a part or component used in an application in which a key design criterion is the energy absorbed during deformation of the part, including exposure to impact, explosive blast, and/or other forms of shock loading.

BACKGROUND

The statements in this section merely provide background information related to the present disclosure and may not constitute prior art.

Titanium alloys are commonly used for aircraft containment casings to prevent failed turbine fan blades from causing damage to the aircraft or surroundings in the event of a blade failure and release. Currently, several aircraft engine manufacturers use a titanium alloy described as Ti-6Al-4V for the material from which the containment casings are formed. This nomenclature is used to define a titanium alloy that includes 6% aluminum (Al) and 4% vanadium (V) by weight. While the Ti-6Al-4V alloy is highly functional, the containment performance is less than desired in many applications and the manufacturing or processing cost associated with using this alloy is relatively high.

SUMMARY

The present disclosure generally relates to a titanium alloy developed for use in applications that require the alloy to resist failure under conditions of impact, explosive blast or other forms of shock loading. In one form, the titanium alloys prepared according to the teachings of the present disclosure provide a performance gain and/or cost savings over conventional alloys when used in such harsh applications. The titanium alloys of the present disclosure have a titanium base with added amounts of aluminum, at least one isomorphous beta stabilizing element, at least one eutectoid beta stabilizing element, and incidental impurities, which results in mechanical properties of a yield strength between about 550 and about 850 MPa; an ultimate tensile strength that is between about 600 MPa and about 900 MPa; a ballistic impact resistance that is greater than about 120 m/s at the $V_{50}$ ballistic limit; and a machinability V15 turning benchmark that is above 125 m/min. Optionally, the titanium alloys may further exhibit a percent elongation that is between about 19% and about 40%. These titanium alloys also exhibit a hot workability that is greater than the hot workability exhibited by a Ti-6Al-4V alloy under the same or similar conditions, having a flow stress that is less than about 200 MPa measured at 1/sec and 800° C.

According to another aspect of the present disclosure, the titanium alloys comprise aluminum (Al) in an amount ranging between about 0.5 wt. % to about 1.6 wt. %; vanadium (V) in an amount ranging between about 2.5 wt. % to about 5.3 wt. %; silicon (Si) in an amount ranging between 0.1 wt. % to about 0.5 wt. %; iron (Fe) in an amount ranging between 0.05 wt % to about 0.5 wt. %; oxygen (O) in an amount ranging between about 0.1 wt. % to about 0.25 wt. %; carbon (C) in an amount up to about 0.2 wt. %; and the remainder being titanium (Ti) and incidental impurities.

The titanium alloys as prepared according to the teachings of the present disclosure may exhibit up to a 70% or more improvement in ductility over a conventional Ti-6Al-4V alloy. The titanium alloys of the present disclosure may also exhibit up to a 16% improvement in ballistic impact resistance over a conventional Ti-6Al-4V alloy. These titanium alloys can also absorb up to 50% more energy than the Ti-6Al-4V alloy, as set forth in greater detail below.

According to another aspect of the present disclosure, a method of forming a product or part from a titanium alloy for use in applications that expose the titanium alloy to impact, explosive blast, or other forms of shock loading, generally, comprises combining scrap or recycled alloy materials that contain titanium, aluminum, and vanadium; mixing the scrap or recycled alloy materials with additional raw materials as necessary to create a blend that comprises the composition of the titanium alloys taught above and herein: melting the blend in either a plasma or electron beam cold hearth furnace, or a vacuum arc remelt (VAR) furnace, to form an ingot; processing the ingot into a part using a combination of beta forging and alpha forging; heat treating the processed part at a temperature between about 25° F. (14° C.) and about 200° F. (110° C.) below the beta transus; and annealing the processed and heat treated part at a temperature between about 750° F. (400° C.) and about 1,200° F. (649° C.) to form a final titanium alloy product. Optionally, the ingot, which may be solid or hollow, that is formed during cold hearth melting may be remelted using vacuum arc remelting with a single or multiple melting steps/methods. The final titanium alloy product may have a volume fraction of a primary alpha phase that is between about 5% to about 90%, depending on the solution treatment temperature, and on the cooling rate from that temperature. This primary alpha phase is characterized by alpha grains having a size that is less than about 50 μm.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

Figure 1:
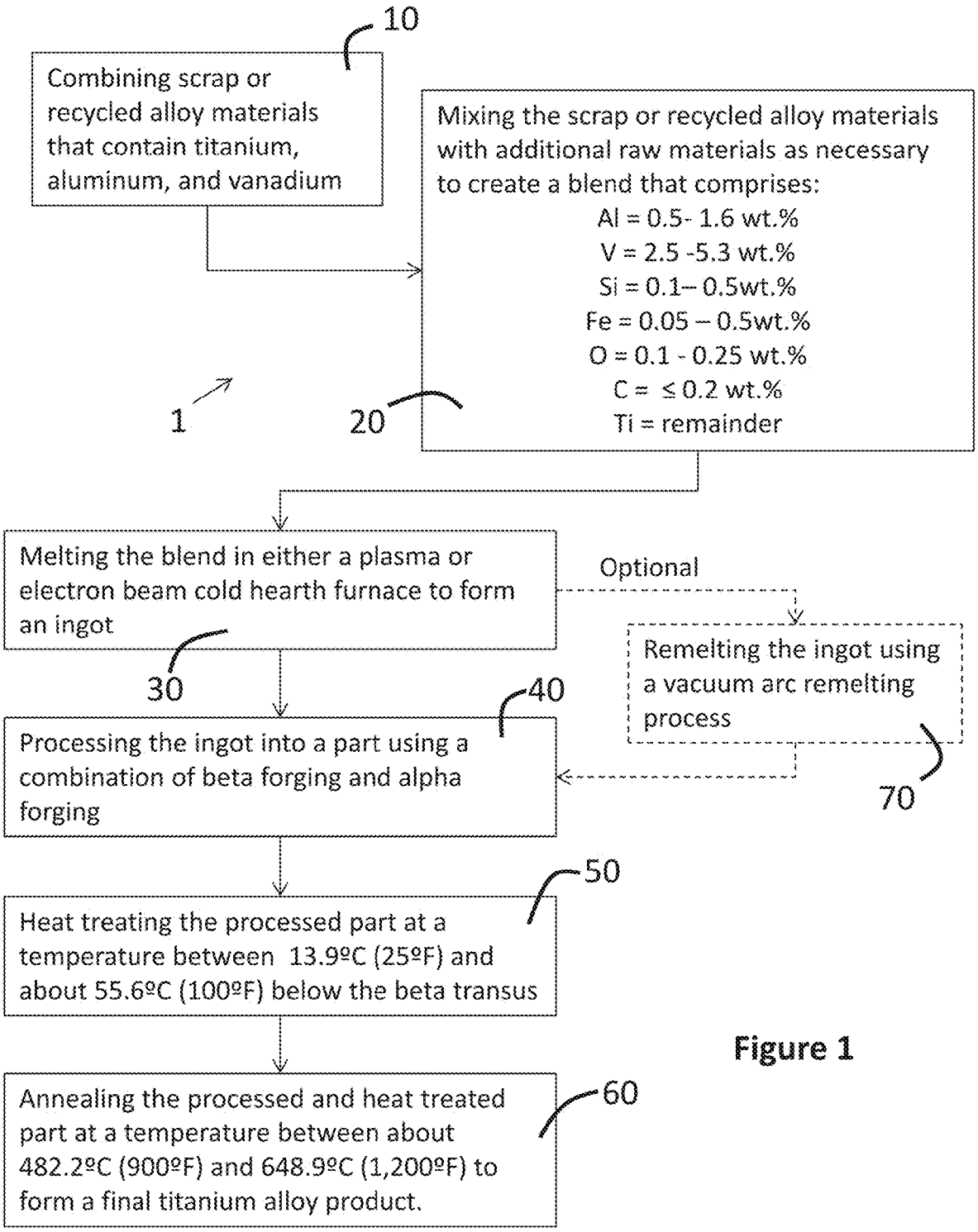
FIG. 1 is a schematic representation of a method for forming a part using the titanium alloys prepared according to the teachings of the present disclosure.

The following description is merely exemplary in nature and is in no way intended to limit the present disclosure or its application or uses. It should be understood that throughout the description, corresponding reference numerals indicate like or corresponding parts and features.

The present disclosure generally relates to titanium alloys for use in applications in which a key design criterion is the energy absorbed during deformation of the part, including impact, explosive blast, or other forms of shock loading. The titanium alloy made and used according to the teachings contained herein provides a performance gain and/or cost savings when used in such harsh applications. The titanium alloy is described throughout the present disclosure in conjunction with use in an aircraft engine containment casing in order to more fully illustrate the concept. When used in an aircraft (e.g., jet) engine containment casing, the titanium alloy typically takes the form of a ring that surrounds the fan blade and maintains containment of the blade in the event of a failure of that component. The incorporation and use of the titanium alloy in conjunction with other types of applications in which the alloy may be exposed to impact, explosive blast, or other forms of shocking loading is contemplated to be within the scope of this disclosure.

The titanium alloys prepared according to the teachings of the present disclosure possess a balance of several traits or properties that provide an all-around improvement over conventional titanium alloys that are commonly used for engine containment. All properties are tested for in samples prepared in production simulated processing and under various heat treatment conditions. The properties and associated range measured for the properties exhibited by the titanium alloys of the present disclosure include: (a) a yield strength between about 550 and about 850 MPa; (b) an ultimate tensile strength between about 600 and about 900 MPa; (c) a ballistic impact resistance greater than 120 m/s at the $V_{50}$ ballistic limit; (d) a machinability V15 turning benchmark above 125 m/min compared to a V15 of 70 m/min for conventional Ti-6Al-4V in lathe machining; and (e) an improved hot workability versus a conventional Ti-6Al-4V alloy. According to another aspect of the present disclosure, the titanium alloys may further exhibit (f) a percent elongation between about 19% and about 40% and (g) a flow stress less than about 200 MPa measured at 1.0/s and 800° C. The titanium alloys exhibit properties that are within the ranges described above because many of these traits are influenced by one another. For example, the mechanical properties and texture properties exhibited by the titanium alloys influence the alloys' ballistic impact resistance.

In comparison to traditional or conventional titanium alloys, such as a Ti-6Al-4V alloy, that are used in applications which expose the alloy to impact, explosive blast, or other forms of shock loading, the titanium alloys of the present disclosure provide both a performance gain and a manufacturing cost savings. The titanium alloy formulations of the present disclosure exhibit excellent energy absorption under high strain rate conditions, as well as excellent workability and machinability. This combination of performance and manufacturing capability enables the design of containment systems and functional components formed from these titanium alloys in which containment of high velocity or ballistic impact is of importance at the lowest practical cost.

The titanium alloys according to the present disclosure may also be selected for use on economic grounds, due to their advantages in component manufacture, where their strength and/or corrosion resistance is adequate for the application, even where blast, shock loading, or ballistic impact are not key design criterion.

The titanium alloys of the present disclosure, in one form, include a titanium base with alloy additions of aluminum, vanadium, silicon, iron, oxygen, and carbon. More specifically, the titanium alloys comprise aluminum (Al) in an elemental amount ranging between about 0.5 wt. % to about 1.6 wt. %, vanadium (V) in an elemental amount ranging between about 2.5 wt. % to about 5.3 wt. %, silicon (S)i in an elemental ranging between about 0.1 wt. % to about 0.5 wt. %, iron (Fe) in an amount ranging between about 0.05 wt. % to about 0.5 wt. %, oxygen (O) in an amount ranging between about 0.1 wt. % to about 0.25 wt. %, carbon (C) in an amount up to about 0.2 wt. %, and the remainder being titanium (Ti) with incidental impurities. Alternatively, the Al in the titanium alloys is present in an amount ranging between about 0.55 wt. % to about 1.25 wt. %, V is present in an amount ranging between about 3.0 wt. % to about 4.3 wt. %, Si in an amount ranging between about 0.2 wt. % to about 0.3 wt., Fe is in an amount ranging between about 0.2 wt. % to about 0.3 wt. %, and O is in an amount ranging between about 0.11 wt. % and about 0.20 wt. %. Titanium alloys having a composition comprising elements within these disclosed compositional ranges exhibit a yield strength, ultimate tensile strength, ballistic impact resistance, and machinability V15 turning benchmark that are within the property ranges indicated above and further described herein, as well as a hot workability that is greater than the hot workability exhibited by a Ti-6Al-4V alloy under similar conditions. A titanium alloy having a composition with an amount of at least one element being outside the compositional range disclosed for said element may exhibit one or more, but not all properties that are within the indicated property ranges.

More specifically, target/nominal values for one composition according to the teachings of the present disclosure include Al in an elemental amount of about 0.85 wt. %, V in an elemental amount of about 3.7 wt. %, Si in an elemental amount of about 0.25 wt. %, Fe in an elemental amount of about 0.25%, and O in an elemental amount of about 0.15 wt. %. Furthermore, the density of this target composition is about 4.55 g/cm$^3$.

In still another form, the Al may be replaced, either entirely or in part, by equivalent amounts of another alpha stabilizer, including but not limited to Zirconium (Zr), Tin (Sn), and Oxygen (O), among others, or any combination thereof. Also, the V may be replaced, either entirely or in part, by equivalent amounts of another isomorphous beta stabilizing element, including but not limited to Molybdenum (Mo), Niobium (Nb), and Tungsten (W), among others, or any combination thereof. Also, the Fe may be replaced, either entirely or in part, by equivalent amounts of another eutectoid beta stabilizing element, including but not limited to Chromium (Cr), Copper (Cu), Nickel (Ni), Cobalt (Co), and Manganese (Mn), among others, or any combination thereof. Additionally, the Si may be replaced, either entirely or in part, by Germanium (Ge).

The Al substitutions using alpha stabilizers may be determined by the following Al Equivalence Equation:

$$\text{Al Equivalent (\%)}=\text{Al}+\text{Zr}/6+\text{Sn}/3+10*\text{O} \quad \text{(Eq. 1)}$$

Additionally, the V substitutions using beta stabilizers may be determined by the following V Equivalence Equation:

$$\text{V Equivalent (\%)}=\text{V}+3\text{Mo}/2+\text{Nb}/2+9(\text{Fe}+\text{Cr})/2 \quad \text{(Eq. 2)}$$

Al substitutions and V substitutions may include up to 1 wt. % of each element, except for oxygen which may include up to 0.5 wt. %. The total substitutions for Al or V in the alloy may be less than or equal to 2 wt. %.

According to another aspect of the present disclosure, the titanium alloy is prepared according to a method 1 described by multiple steps shown in FIG. 1. This method 1 generally comprises the step 10 of combining recycled materials or scrap materials made from alloys that contain Ti, Al, and V. Alternatively, these scrap or recycled materials include components or parts that were formed from the titanium alloys of the present disclosure. The recycled scrap materials are then mixed in step 20 with additional raw materials of the appropriate chemistry as necessary to create a blend that exhibits, on average, a composition that is within the elemental ranges set forth above for the desired titanium alloys. The blend is melted in step 30 in a plasma or electron beam cold hearth furnace, in one form of the method, to create an ingot. In another form, the blend is melted in step 30 in a vacuum arc remelt (VAR) furnace. The ingot is then processed in step 40 into a part using a combination of beta forging and alpha beta forging. The processed part is finally heat treated in step 50 at a temperature between about 25° F. (14° C.) and about 200° F. (110° C.) below the beta transus followed by an annealing step 60 at a temperature between about 482.2° C. 750° F. (400° C.) and about 1200° F. (649° C.) to form the final titanium alloy product. One skilled in the art will understand that the beta transus refers to the lowest temperature at which a 100% beta phase can exist in the alloy composition. In one form, the processed part is heat treated in step 50 at about 75° F. (42° C.) below the beta transus and annealed in step 60 at about 932° F. (500° C.). Optionally, the ingot formed in the cold hearth melting step 30 may be remelted in step 70 using vacuum arc remelting, with a single or multiple melting steps/methods.

The ingot formed in the cold hearth melting step 30 may be a solid ingot or a hollow ingot. The final titanium alloy product after being heat treated in step 50 and annealed in step 60 exhibits a microstructure having a primary alpha phase with a volume fraction that is between about 5% and about 90%, depending on the solution treatment temperature, and the cooling rate from that temperature. The primary alpha phase may comprise primary alpha grains having a size that is less than about 50 μm. In one form, the primary alpha grain size is less than about 20 μm.

The combination of hot working and good room temperature ductility make the invention alloy suitable for processing using combinations of conventional metal working or severe plastic deformation methods and heat treatments to produce grain sizes including grain sizes below 10 μm that offer advantages in superplastic forming processes combined with increased strengths or ultra fine grain sizes below 1 μm that can provide additional advantages.

The following specific embodiments are given to illustrate the composition, properties, and use of titanium alloys prepared according to the teachings of the present disclosure and should not be construed to limit the scope of the disclosure. Those skilled in the art, in light of the present disclosure, will appreciate that many changes can be made in the specific embodiments which are disclosed herein and still obtain alike or similar result without departing from or exceeding the spirit or scope of the disclosure.

Mechanical property testing is performed and compared for titanium alloys prepared according to the teachings of the present disclosure in both small laboratory scale quantities (Alloy No.'s A-1 to A-24) and large production scale quantities (Alloy No.'s F-1 to F-6) that are within the claimed compositional range and outside the claimed compositional range, and on conventional alloys (Alloy No.'s C-1 to C-3) that are either currently in use or potentially suitable for use in a containment application. As used herein, the term "small laboratory scale quantities" means quantities of less than or equal to 2,000 lbs and the term "large production scale quantities" means quantities greater than than 2,000 lbs. A further description of Alloy No.'s A-1 to A-24, F-1 to F-6, and C-1 to C-3 is provided below.

One skilled in the art will understand that any properties reported herein represent properties that are routinely measured and can be obtained by multiple different methods. The methods described herein represent one such method and other methods may be utilized without exceeding the scope of the present disclosure.

Example 1 —Ductility Testing

Laboratory Scale - Ductility was measured in tensile tests performed on material samples (Alloy No.'s A-1 to A-17, C1, C2) produced from 8.0 in. (20 cm) diameter laboratory ingots that are prepared by vacuum arc remelting beta forged, alpha/beta forged, and alpha/beta rolled to a thickness between 0.40 in. (1 cm) and 0.75 in. (1.9 cm). In addition, many more alloy compositions were tested after being produced from 150 g buttons (A-18 to A-24), which are rolled in 0.5 in. RCS (round corner square). Tensile tests were performed according to the procedures described in ASTM E8 (ASTM International, West Conshohoken, Pa.).

The titanium alloys were subjected to various heat treatments and aging conditions prior to tensile material samples being extracted and tested. The various heat treatment to which the tensile material samples are subjected include solution heat treatment at about 75° F. (42° C.) below the beta transus temperature for 1 hour followed by i) air cooling and aging at about 932° F. (500° C.) for 8 hours [ST/AC/Age], ii) water quenching and aging at about 932° F. (500° C.) for 8 hours [ST/WQ/Age], or iii) air cooling and over aging at about 1292° F. (700° C.) for 8 hours [ST/AC/OA]. The titanium alloys of the present disclosure exhibit a hot workability that is greater than the hot workability exhibited by a Ti-6Al-4V alloy under the same or similar conditions.

In addition, many more alloy compositions were tested after being produced from 150 g buttons which are rolled to 0.5 in. RCS (round corner square) and annealed at approximately 100° F. (56° C.) below the beta transus temperature. The titanium alloys (Alloy No.'s A-1 to A-6) exhibit up to 70% improvement in ductility as compared to a conventional Ti-6Al-4V alloy (Alloy No. C-1), while still maintaining enough strength to meet all necessary or desired requirements for use in a containment application. The titanium alloys of the present disclosure exhibit an ultimate tensile strength that is between about 600 MPa and about 900 Mpa. During processing, the titanium alloys of the present disclosure exhibit a flow stress that is less than about 200 Mpa measured at 1.0/sec and 800° C.

While the conventional Ti-3Al-2.5V alloy (Alloy No. C-2) meets basic mechanical properties for strength and ductility, it absorbs less than 85% of the energy when compared to the alloy of the present disclosure (see Example 3). Also, the alloy of the present disclosure possesses a 44% lower flow stress than Ti-3Al-2.5V, which is beneficial for formability.

Production Scale—In addition, similar testing was performed on material from production scale electron beam single melt (EBSM) ingots around 12,000 lbs (F-1 to F-6). Results of this testing demonstrated similar ductility and strength results to laboratory scale testing. Small scale rolling experiments conducted on this material showed the material could be processed down to lower temperatures than would conventionally be applied to Ti-6Al-4V without process difficulty, or a dramatic effect on properties. Due to the improvement in ductility and ability to process to lower temperatures, about a 5000 lb ring of the alloy required only 50% of the reheats required to roll a similar ring of a conventional Ti-6Al-4V alloy, and thus a significant processing cost saving.

Figure 3:
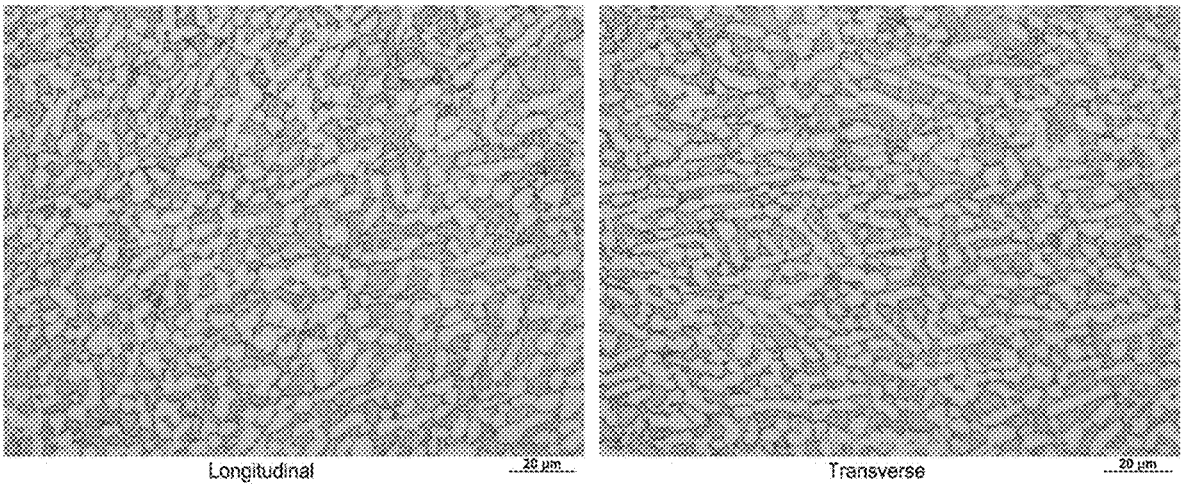
FIG. 3 is an example microstructure of a titanium alloy prepared according to the teachings of the present disclosure.

FIG. 3 provides an example microstructure of a titanium alloy prepared according to the teachings of the present disclosure. The as shown microstructure of alloy F-3 contains 46% volume fraction primary alpha with an average grain size of 4.1 μm.

The composition of the titanium alloys upon which mechanical property testing and other testing was conducted is provided in Table 1:

TABLE 1

Titanium alloy compositions used in mechanical property testing

| Alloy No. | Ti - Alloy Description | Al wt. % | V wt. % | Si wt. % | Fe wt. % | O wt. % | Remainder | Scale |
|---|---|---|---|---|---|---|---|---|
| A-1 | .7Al—3.8V—.25Si—.1Fe | 0.73 | 3.68 | 0.25 | 0.09 | 0.08 | Ti | Laboratory |
| A-2 | .55Al—3V—.25Si—.25Fe | 0.57 | 2.78 | 0.22 | 0.23 | 0.12 | Ti | Laboratory |
| A-3 | .8Al—3.9V—.25Si—.08Fe | 0.75 | 3.9 | 0.26 | 0.08 | 0.14 | Ti | Laboratory |
| A-4 | .75Al—4V—.25Si—.14Fe | 0.79 | 3.94 | 0.24 | 0.23 | 0.14 | Ti | Laboratory |
| A-5 | 1.05Al—4.4V—.35Si—.17Fe | 1.08 | 4.24 | 0.23 | 0.31 | 0.18 | Ti | Laboratory |
| A-6 | .9Al—4V—.2Si—.16Fe | 0.93 | 3.86 | 0.22 | 0.27 | 0.17 | Ti | Laboratory |
| A-7 | 1Al—3.9V—.25Si | 1.04 | 3.9 | 0.27 | 0.05 | 0.13 | Ti | Laboratory |
| A-8 | 1.1Al—5V—.25Si—.1Fe | 1.14 | 4.95 | 0.28 | 0.11 | 0.12 | Ti | Laboratory |
| A-9 | .7Al—3.9V—.3Si—.1Fe | 0.7 | 3.94 | 0.33 | 0.1 | 0.16 | Ti | Laboratory |
| A-10 | .45Al—3.5V—.15Si—.15Fe | 0.45 | 3.51 | 0.16 | 0.14 | 0.12 | Ti | Laboratory |
| A-11 | .6Al—3.9V—.25Si—.15Fe | 0.58 | 3.9 | 0.23 | 0.18 | 0.15 | Ti | Laboratory |
| A-12 | .9Al—3.9V—.25Si—.25Fe—0.10O | 0.9* | 3.9* | 0.25* | 0.25* | 0.11 | Ti | Laboratory |
| A-13 | .9Al—3.9V—.25Si—.25Fe—0.12O | 0.9* | 3.9* | 0.25* | 0.25* | 0.12 | Ti | Laboratory |
| A-14 | .9Al—3.9V—.25Si—.25Fe—0.14O | 0.9* | 3.9* | 0.25* | 0.25* | 0.14 | Ti | Laboratory |
| A-15 | .9Al—3.9V—.25Si—.25Fe—0.16O | 0.9* | 3.9* | 0.25* | 0.25* | 0.16 | Ti | Laboratory |
| A-16 | .9Al—3.9V—.25Si—.25Fe—0.18O | 0.9* | 3.9* | 0.25* | 0.25* | 0.17 | Ti | Laboratory |
| A-17 | .9Al—3.9V—.25Si—.25Fe—0.20O | 0.9* | 3.9* | 0.25* | 0.25* | 0.21 | Ti | Laboratory |
| A-18 | 1Al—4V—.05Fe | 1.0* | 4.0* | — | 0.05* | 0.1 | Ti | Laboratory |
| A-19 | 2Al—4V—.05Fe | 2.0* | 4.0* | — | 0.05* | 0.08 | Ti | Laboratory |
| A-20 | 3Al—4V—.05Fe | 3.0* | 4.0* | — | 0.05* | 0.08 | Ti | Laboratory |
| A-21 | 1Al—3V—2Sn—.05Fe | 1.0* | 3.0* | — | 0.05* | 0.08 | Sn 2 wt. % Ti | Laboratory |
| A-22 | 1Al—3V—.5Si—.05Fe | 1.0* | 3.0* | 0.50* | 0.05* | 0.12 | Ti | Laboratory |
| A-23 | 1Al—4V—.25Si—.05Fe | 1.0* | 4.0* | 0.25* | 0.05* | 0.08 | Ti | Laboratory |
| A-24 | 2Al—4V—.25Si—.05Fe | 2.0* | 4.0* | 0.25* | 0.05* | 0.08 | Ti | Laboratory |
| F-1 | .7Al—3.1V—.25Si—.25Fe | 0.68 | 3.08 | 0.26 | 0.26 | 0.14 | Ti | Production |
| F-2 | .7Al—3.1V—.25Si—.25Fe | 0.66 | 3.04 | 0.25 | 0.28 | 0.14 | Ti | Production |
| F-3 | .85Al—3.7V—.25Si—.25Fe | 0.9 | 3.7 | 0.23 | 0.29 | 0.15 | Ti | Production |
| F-4 | .85Al—3.7V—.25Si—.25Fe | 0.84 | 3.6 | 0.23 | 0.27 | 0.15 | Ti | Production |
| F-5 | .85Al—3.7V—.25Si—.25Fe | 0.88 | 3.81 | 0.25 | 0.3 | 0.15 | Ti | Production |
| F-6 | .85Al—3.7V—.25Si—.25Fe | 0.9 | 3.87 | 0.29 | 0.29 | 0.15 | Ti | Production |
| C-1 | 6Al—4V | 5.99 | 3.92 | — | 0.14 | 0.16 | Ti | Laboratory |
| C-2 | 3Al—2.5V | 3.19 | 2.49 | — | 0.08 | 0.1 | Ti | Laboratory |
| C-3 | 6Al—4V | 6.6 | 4.2 | 0.1 | 0.18 | 0.19 | Ti | Production |

*Denotes AIM chemistry

Results of the mechanical property testing are provided in Table 2.

TABLE 2

Tensile property testing of alloys listed in Table 1 (Average of longitudinal and transverse.)

| Alloy No. | Ti - Alloy Description | YS (MPa) | UTS (MPa) | 4d El (%) | Condition | Scale |
|---|---|---|---|---|---|---|
| A-1 | .7Al—3.8V—.25Si—.1Fe | 548 | 612 | 27.5 | ST/AC/Age | Laboratory |
| A-2 | .55Al—3V—.25Si—.25Fe | 559 | 639 | 27.8 | ST/AC/Age | Laboratory |
| A-3 | .8Al—3.9V—.25Si—.08Fe | 622 | 689 | 25.2 | ST/AC/Age | Laboratory |
| A-3 | .8Al—3.9V—.25Si—.08Fe | 735 | 814 | 20 | ST/WQ/Age | Laboratory |
| A-4 | .75Al—4V—.25Si—.14Fe | 648 | 730 | 25.5 | ST/AC/Age | Laboratory |
| A-5 | 1.05Al—4.4V—.35Si—.17Fe | 748 | 817 | 22.8 | ST/AC/Age | Laboratory |
| A-6 | .9Al—4V—.2Si—.16Fe | 666 | 750 | 23.9 | ST/AC/Age | Laboratory |
| A-7 | 1Al—3.9V—.25Si | 602 | 689 | 25 | ST/AC/Age | Laboratory |
| | 1Al—3.9V—.25Si | 712 | 795 | 19.5 | ST/WQ/Age | Laboratory |
| A-8 | 1.1Al—5V—.25Si—.1Fe | 591 | 679 | 24.6 | ST/AC/Age | Laboratory |
| | 1.1Al—5V—.25Si—.1Fe | 788 | 865 | 19.2 | ST/WQ/Age | Laboratory |
| A-9 | .7Al—3.9V—.3Si—.1Fe | 826 | 833 | 22.9 | ST/WQ/Age | Laboratory |
| A-10 | .45Al—3.5V—.15Si—.15Fe | 549 | 643 | 27.9 | ST/AC/Age | Laboratory |
| A-11 | .6Al—3.9V—.25Si—.15Fe | 641 | 722 | 25.2 | ST/AC/Age | Laboratory |
| A-12 | .9Al—3.9V—.25Si—.25Fe—0.10O | 603 | 676 | 25.7 | ST/AC/Age | Laboratory |
| A-13 | .9Al—3.9V—.25Si—.25Fe—0.12O | 610 | 676 | 23.9 | ST/AC/Age | Laboratory |
| A-14 | .9Al—3.9V—.25Si—.25Fe—0.14O | 627 | 702 | 25 | ST/AC/Age | Laboratory |
| A-15 | .9Al—3.9V—.25Si—.25Fe—0.16O | 650 | 719 | 23.9 | ST/AC/Age | Laboratory |
| A-16 | .9Al—3.9V—.25Si—.25Fe—0.18O | 672 | 750 | 23.8 | ST/AC/Age | Laboratory |
| A-17 | .9Al—3.9V—.25Si—.25Fe—0.20O | 715 | 791 | 24.2 | ST/AC/Age | Laboratory |
| A-18 | 1Al—4V—.05Fe | 427 | 607 | 28.5 | ST/AC/OA | Laboratory |
| A-19 | 2Al—4V—.05Fe | 448 | 605 | 27 | ST/AC/OA | Laboratory |

TABLE 2-continued

Tensile property testing of alloys listed in Table 1 (Average of longitudinal and transverse.)

| Alloy No. | Ti - Alloy Description | YS (MPa) | UTS (MPa) | 4d El (%) | Condition | Scale |
|---|---|---|---|---|---|---|
| A-20 | 3Al—4V—.05Fe | 508 | 649 | 26.5 | ST/AC/OA | Laboratory |
| A-21 | 1Al—3V—2Sn—.05Fe | 409 | 573 | 27.5 | ST/AC/OA | Laboratory |
| A-22 | 1Al—3V—.5Si—.05Fe | 603 | 659 | 24 | ST/AC/OA | Laboratory |
| A-23 | 1Al—4V—.25Si—.05Fe | 477 | 616 | 32 | ST/AC/Age | Laboratory |
| A-24 | 2Al—4V—.25Si—.05Fe | 532 | 668 | 28.5 | ST/AC/Age | Laboratory |
| F-1 | .7Al—3.1V—.25Si—.25Fe | 610 | 691 | 23.3* | ST/AC/Age | Production |
| F-2 | .7Al—3.1V—.25Si—.25Fe | 558 | 771 | 23.6 | ST/AC/Age | Production |
| F-3 | .85Al—3.7V—.25Si—.25Fe | 709 | 783 | 21.8* | ST/AC/Age | Production |
| F-4 | .85Al—3.7V—.25Si—.25Fe | 670 | 756 | 25.8* | ST/AC/Age | Production |
| F-5 | .85Al—3.7V—.25Si—.25Fe | 683 | 768 | 25.8* | ST/AC/Age | Production |
| F-6 | .85Al—3.7V—.25Si—.25Fe | 670 | 750 | 23.7* | ST/AC/Age | Production |
| C-1 | 6Al—4V | 895 | 972 | 16 | ST/WQ/Age | Laboratory |
| C-2 | 3Al—2.5V | 639 | 715 | 21.2 | ST/AC/Age | Laboratory |
| C-2 | 3Al—2.5V | 689 | 770 | 18 | ST/WQ/Age | Laboratory |

*Denotes estimated conversion factor of 1.25 from 6.4D El % to 4D El %

Example 2 —Ballistic Impact Testing

Figure 2:
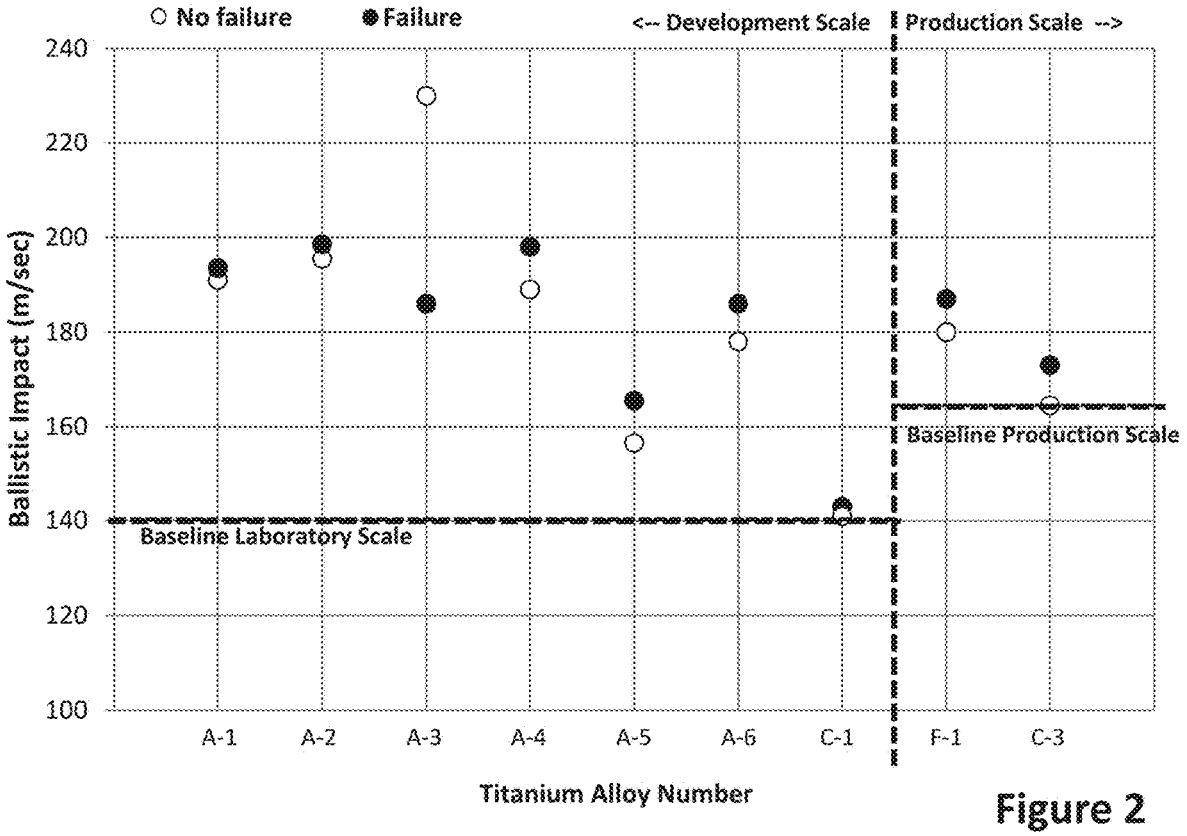
FIG. 2 is a graphical representation of the ballistic impact resistance exhibited by titanium alloys prepared according to the teachings of the present disclosure compared against a conventional Ti-6Al-4V alloy.

Ballistic impact tests were performed on the titanium alloy compositions as shown in Table 3. Ballistic impact tests were performed on material test plates produced from 8 in. (20 cm) laboratory scale ingots that were prepared by multiple vacuum arc remelting, beta forged, alpha/beta forged with an intermediate beta workout, and alpha/beta rolled to around 0.30 in. (7.6 mm) in thickness. The material test plates were solution treated at 75° F. (42° C.) below their beta transus temperature and aged or annealed at 932° F. (500° C.). The results of the ballistic impact testing are shown in FIG. 2.

The titanium alloys (Alloy No.'s A-1 to A-6) exhibit up to about 16% greater ballistic impact resistance than the ballistic impact resistance exhibited by a conventional Ti-6Al-4V alloy (Alloy No. C-1). In one form, the titanium alloys of the present disclosure exhibit a ballistic impact resistance that is greater than about 120 m/s at the $V_{50}$ ballistic limit. Ballistic impact tests were performed using a cylindrical, round-nose solid projectile. Similar results are achieved for the comparison of ballistic impact tests carried out on the aforementioned production scale ingot (Alloy No. F-1) against ballistic impact results obtained for a conventional production ingot C-3.

TABLE 3

Alloys Used in Ballistic Impact Testing

| Alloy No. | Alloy Type | Al | V | Si | Fe | O | Scale |
|---|---|---|---|---|---|---|---|
| A-1 | .7Al—3.8V—.25Si—.1Fe | 0.73 | 3.68 | 0.25 | 0.09 | 0.08 | Laboratory |
| A-2 | .55Al—3V—.25Si—.25Fe | 0.57 | 2.78 | 0.22 | 0.23 | 0.12 | Laboratory |
| A-3 | .8Al—3.9V—.25Si—.08Fe | 0.75 | 3.90 | 0.26 | 0.08 | 0.14 | Laboratory |
| A-4 | .75Al—4V—.25Si—.14Fe | 0.79 | 3.94 | 0.24 | 0.23 | 0.14 | Laboratory |
| A-5 | 1.05Al—4.4V—.35Si—.17Fe | 1.08 | 4.24 | 0.23 | 0.31 | 0.18 | Laboratory |
| A-6 | .9Al—4V—.2Si—.16Fe | 0.93 | 3.86 | 0.22 | 0.27 | 0.17 | Laboratory |
| C-1 | 6Al— 4V | 5.99 | 3.92 | — | 0.14 | 0.16 | Laboratory |
| C-3 | 6Al— 4V | 6.6 | 4.2 | 0.1 | 0.18 | 0.19 | Production |
| F-1 | .85Al—3.1V—.25Si—.25Fe | 0.7 | 3.1 | 0.26 | 0.26 | 0.14 | Production |

Example 3—Charpy Impact (V-Notch) Testing

Charpy Impact (V-Notch) tests were performed on Charpy material test samples produced from 8.0 in. (20 cm) laboratory scale ingots that were prepared by vacuum arc remelting beta forging, alpha/beta forging, and alpha/beta rolled to a thickness of about 0.75 in. (1.9 cm). The Charpy impact test plates were solution treated at 75° F. (42° C.) below their beta transus temperature and aged or annealed at 932° F. (500° C.), both of which were conducted with ambient air cooling. The composition of the titanium alloys upon which Charpy Impact (V-Notch) testing is conducted is provided in Table 4:

TABLE 4

Alloys used in Charpy Impact (V-Notch) Testing

| Alloy No. | Alloy Type | Al | V | Si | Fe | O | Ti wt. % |
|---|---|---|---|---|---|---|---|
| A-1 | .7Al—3.8V—.25Si—.1Fe | 0.73 | 3.68 | 0.25 | 0.09 | 0.08 | Remainder |
| A-2 | .55Al—3V—.25Si—.25Fe | 0.57 | 2.78 | 0.22 | 0.23 | 0.12 | Remainder |
| C-1 | 6Al—4V | 5.99 | 3.92 | — | 0.14 | 0.16 | Remainder |
| C-2 | 3Al—2.5V | 3.19 | 2.49 | — | 0.08 | 0.10 | Remainder |

Two samples for each alloy composition (Alloy No.'s A-1, A-2, C-1, & C-2) were evaluated during the Charpy Impact (V-Notch) testing with the results obtained for each alloy provided in Table 5:

TABLE 5

Results of Charpy Impact (V-Notch) Testing

| Alloy No. | Sample No. | Temp. (° F.) | Energy (ft-lbs) | Lateral Expansion (mils) |
|---|---|---|---|---|
| C-1 | 1 | 74 | 41 | 17 |
| | 2 | 74 | 46 | 24 |
| C-2 | 1 | 74 | 70 | 44 |
| | 2 | 74 | 67 | 45 |
| A-1 | 1 | 74 | 80 | 56 |
| | 2 | 74 | 76 | 53 |
| A-2 | 1 | 74 | 82 | 56 |
| | 2 | 74 | 81 | 58 |
| A-3 | 1 | 74 | 71 | 48 |
| | 2 | 74 | 77 | 50 |

Note:
1 mil = 0.00254 cm

The titanium alloys prepared according to the teachings of the present disclosure (Alloy No.'s A-1 & A-2) absorb more energy than that absorbed by conventional titanium alloys (Alloy No.'s C-1 & C-2). In fact, the titanium alloys of the present disclosure (Alloy No.'s A-1 & A-2) absorb up to 50% more energy than that absorbed by a conventional Ti-6Al-4V alloy (Alloy No. C-1) under this Charpy Impact (V-Notch) testing. (Charpy Impact (V-Notch) tests are performed according to the procedures described in ASTM E23). Additionally, the titanium alloys of the present disclosure also exhibit a percent elongation that is between about 19% and about 40%.

Example 4—Machinability

Lathe machinability V15 tests were performed on some of the titanium alloy compositions described in Table 1 above. Machinability V15 tests were performed, where V15 refers to the speed of a cutting tool that is worn out within 15 minutes. Feed rate was 0.1 mm/rev, and the radial depth of cut was 2 mm by a variable speed outer diameter turning operation using a CNMG 12 04 08-23 H13A progressive tool insert with C5-DCLNL-35060-12 holder. The titanium alloys prepared according to the present disclosure exhibit a machinability V15 turning benchmark that is above 125 m/min. In fact, the titanium alloys of the present invention are capable of being machined over 100% easier than a conventional Ti-6Al-4V alloy. In one test, an alloy substantially similar to the A-3 alloy as set forth above demonstrated a V15 value of 187.5 m/min, versus the baseline Ti-6Al-4V alloy (Alloy No. C-2) that demonstrated a value of 72 m/min. Thus the titanium alloys of the present disclosure exhibit an improved processing capability over conventional titanium alloys.

Example 5—Effect of Cooling Rate

Cooling rate study performed on 0.5" rolled plate from a production scale ingot of the alloy. Samples with cooling rates ranging between out 1° C./min and about 850° C./min resulted in yield strength between about 600 MPa and about 775 MPa with UTS between about 700 MPa and about 900 MPa. Results of this study are provided in Table 7.

TABLE 7

Effect of solution treatment cooling rate on mechanical properties (Average of longitudinal and transverse conditions with samples aged after solution heat treatment).

| Alloy No. | Ti - Alloy Description | Estimated Cooling Rate | YS (MPa) | UTS (MPa) | 4d El (%) |
|---|---|---|---|---|---|
| F-4 | .85Al—3.7V—.25Si—.25Fe | 850° C./min | 776 | 882 | 22.8 |
| F-4 | .85Al—3.7V—.25Si—.25Fe | 500° C./min | 740 | 849 | 24.0 |
| F-4 | .85Al—3.7V—.25Si—.25Fe | 80° C./min | 642 | 742 | 26.8 |
| F-4 | .85Al—3.7V—.25Si—.25Fe | 40° C./min | 618 | 710 | 26.0 |
| F-4 | .85Al—3.7V—.25Si—.25Fe | 30° C./min | 627 | 718 | 25.5 |
| F-4 | .85Al—3.7V—.25Si—.25Fe | 15° C./min | 615 | 701 | 25.3 |
| F-4 | .85Al—3.7V—.25Si—.25Fe | 10° C./min | 626 | 707 | 26.0 |
| F-4 | .85Al—3.7V—.25Si—.25Fe | 5° C./min | 614 | 696 | 27.3 |
| F-4 | .85Al—3.7V—.25Si—.25Fe | 1° C./min | 616 | 693 | 26.8 |

Example 6—Flow Stress

Compressive flow stress was measured for the alloys prepared according to the present disclosure and compared to conventional alloys Ti-6Al-4V (Alloy No. C-1) and Ti-3Al-2.5V (Alloy No. C-2). Comparatively, at 1472° F. (800° C.) and a strain rate of 1.0/s the alloys of the present disclosure has 44% reduced peak flow stress compared with Ti-3Al-2.5V (Alloy No. C-2) and a 57% reduced peak flow stress compared with Ti-6Al-4V (Alloy No. C-1). The reduced flow stress makes the alloys of the present disclosure easier to process and form than conventional alloys. The measured flow stress data is presented in Table 8.

TABLE 8

| Peak flow stress | | | | |
|---|---|---|---|---|
| Alloy No. | Ti - Alloy Description | Strain Rate | Temperature | Flow Stress(MPa) |
| A-3 | .8Al—3.9V—.25Si—.08Fe | 1/s | 1472° F. (800° C.) | 146 |
| C-1 | 6Al—4V | 1/s | 1472° F. (800° C.) | 338 |
| C-2 | 3Al—2.5V | 1/s | 1472° F. (800° C.) | 220 |

The foregoing description of various forms of the invention has been presented for purposes of illustration and description. It is not intended to be exhaustive or to limit the invention to the precise forms disclosed. Numerous modifications or variations are possible in light of the above teachings. The forms discussed were chosen and described to provide the best illustration of the principles of the invention and its practical application to thereby enable one of ordinary skill in the art to utilize the invention in various forms and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A method of forming a product or part from a titanium alloy comprising the steps of:

combining scrap or recycled alloy materials that contain titanium, aluminum, and vanadium;

mixing the scrap or recycled alloy materials with additional raw materials as necessary to create a blend;

melting the blend in one of a plasma or electron beam cold hearth furnace, or a vacuum arc remelt (VAR) furnace, to form an ingot, the ingot consisting of:

aluminum in an amount ranging between 0.5 wt. % to 1.6 wt. %;

an isomorphous beta stabilizing element selected from the group consisting of molybdenum, niobium, tungsten, and vanadium in an amount ranging between greater than 3.0 wt. % to 5.3 wt. %;

silicon in an amount between 0.1 wt. % to 0.5 wt. %;

a eutectoid beta stabilizing element selected from the group consisting of chromium, cobalt, copper, iron, manganese, and nickel in an amount ranging between 0.05 wt. % to 0.5 wt. %;

oxygen in an amount ranging between 0.1 wt. % to 0.25 wt. %;

carbon in an amount up to 0.2 wt. %; and the remainder being titanium and incidental impurities;

processing the ingot into a part using a combination of beta forging and alpha/beta forging;

heat treating the processed part at a temperature between 25° F. (14° C.) and 200° F. (110° C.) below the beta transus; and annealing the processed and heat treated part at a temperature between 750° F. (400° C.) and 1,200° F. (649° C.) to form a final titanium alloy product.

2. The method according to claim 1, wherein the ingot consists of:

aluminum in an amount ranging between 0.5 wt. % to 1.6 wt. %;

vanadium in an amount ranging between greater than 3.0 wt. % to 5.3 wt. %;

silicon in an amount ranging between 0.1 wt. % to 0.5 wt. %;

iron in an amount ranging between 0.05 wt. % to 0.5 wt. %;

oxygen in an amount ranging between 0.1 wt. % to 0.25 wt. %;

carbon in an amount up to 0.2 wt. %; and the remainder being titanium and incidental impurities.

3. The method according to claim 1, wherein the aluminum is in an amount ranging between 0.55 wt. % to 1.25 wt. %.

4. The method according to claim 1, wherein the vanadium is in an amount ranging between 3.0 wt. % to 4.3 wt. %.

5. The method according to claim 1, wherein the silicon is in an amount ranging between 0.2 wt. % to 0.3 wt. %.

6. The method according to claim 1, wherein the iron is in an amount ranging between 0.2 wt. % to 0.3 wt. %.

7. The method according to claim 1, wherein the oxygen is in an amount ranging between 0.11 wt. % to 0.2 wt. %.

8. The method according to claim 1 wherein:

the aluminum is in an amount ranging between 0.55 wt. % to 1.25 wt. %;

the vanadium is in an amount ranging between 3.0 wt. % to 4.3 wt. %;

the silicon is in an amount ranging between 0.20 wt. % to 0.30 wt. %;

the iron is in an amount ranging between 0.20 wt. % to 0.30 wt. %;

the oxygen is in an amount ranging between 0.11 wt. % and 0.20 wt. %; and the remainder is titanium and incidental impurities.

9. The method according to claim 1 wherein:

the aluminum is in an elemental amount of 0.85 wt. %;

the vanadium is in an elemental amount of 3.7 wt. %;

the silicon is in an elemental amount of 0.25 wt. %;

the iron is in an elemental amount of 0.25 wt. %;

the oxygen is in an elemental amount of 0.15 wt. %; and the remainder is titanium and incidental impurities.

10. The method according to claim 1, wherein the heat treating is performed at a temperature that is 75° F. (42° C.) below the beta transus and the annealing is performed at a temperature of 932° F. (500° C.).

11. The method according to claim 1, wherein the ingot formed in the cold hearth melting step is a hollow ingot.

12. The method according to claim 1, wherein the ingot formed in the cold hearth melting step is remelted using a vacuum arc remelting process.

13. The method according to claim 1, wherein the final titanium alloy product has a volume fraction of a primary alpha phase that is between 5% to 90%.

14. The method according to claim 13, wherein the primary alpha phase comprises primary alpha grains having a size that is less than 50 μm.

15. The method according to claim 14, wherein the size of the primary alpha grains is less than 20 μm.

16. The method according to claim 1, wherein the final titanium alloy product comprises mechanical properties of:

a yield strength between about 550 and about 850 MPa;

an ultimate tensile strength that is between about 600 MPa and about 900 MPa;

a ballistic impact resistance that is greater than about 120 m/s at the V50 ballistic limit; and a machinability V15 turning benchmark that is above 125 m/min, wherein the final titanium alloy product exhibits a hot workability that is greater than the hot workability exhibited by a Ti-6Al-4V alloy product under identical conditions as measured by flow stress at a given strain, strain rate, and temperature.

17. The method according to claim 1, wherein the final titanium alloy product exhibits up to a 70% improvement in ductility over a Ti-6Al-4V alloy product under identical conditions as measured by tensile testing according to ASTM E8.

18. The method according to claim 1, wherein the final titanium alloy product exhibits up to a 16% improvement in ballistic impact resistance over a Ti-6Al-4V alloy product under identical conditions of ballistic impact in m/sec and resistance as measured by no failure.

19. A part formed from the titanium alloy prepared according to the method of claim 1.

20. The part according to claim 19, wherein the part is a containment ring casing.

* * * * *